US005522679A

United States Patent [19]

Eungard

[11] Patent Number: 5,522,679

[45] Date of Patent: Jun. 4, 1996

[54] BUOYANCY COMPENSATOR HAVING ATTACHED BACKPACK

[75] Inventor: William C. Eungard, Plainfield, Ill.

[73] Assignee: Dacor Corporation, Northfield, Ill.

[21] Appl. No.: 253,095

[22] Filed: Jun. 2, 1994

[51] Int. Cl.[6] ..... B63C 11/08

[52] U.S. Cl. ..... 405/186; 441/108

[58] Field of Search ..... 405/185, 186, 405/187; 2/2.15; 114/315; 441/108, 113, 114, 119, 91–94

[56] References Cited

U.S. PATENT DOCUMENTS

| | | | |
|---|---|---|---|
| 254,580 | 3/1882 | Willard | 441/108 |
| 3,436,777 | 4/1969 | Greenwood | 405/186 |
| 3,820,348 | 6/1974 | Fast | 405/186 |
| 4,437,790 | 3/1984 | Trop | 405/186 |
| 4,523,914 | 6/1985 | Faulconer et al. | 441/108 |
| 4,561,853 | 12/1985 | Faulconer et al. | 441/106 |
| 4,601,609 | 6/1986 | Hyde | 405/186 |
| 4,640,215 | 2/1987 | Purifoy, Jr. | 114/315 |
| 4,681,552 | 7/1987 | Courtney | 441/92 |
| 4,690,314 | 9/1987 | Faulconer et al. | 224/211 |
| 4,694,772 | 9/1987 | Faulconer et al. | 114/315 |
| 4,778,307 | 10/1988 | Faulconer | 405/186 |
| 4,779,554 | 10/1988 | Courtney | 114/315 |
| 4,810,134 | 3/1989 | Faulconer et al. | 405/186 |
| 4,812,083 | 3/1989 | Mosier | 405/186 |
| 4,887,932 | 12/1989 | Toth | 405/186 |
| 4,952,095 | 8/1990 | Walters | 405/186 |
| 4,990,115 | 2/1991 | Vorhauer et al. | 441/111 |
| 5,011,334 | 4/1991 | Vorhauer | 405/186 |
| 5,046,894 | 9/1991 | Bergstrom | 405/186 |
| 5,378,084 | 1/1995 | Walters et al. | 405/186 |
| 5,403,123 | 4/1995 | Walters | 405/186 |

*Primary Examiner*—David J. Bagnell
*Attorney, Agent, or Firm*—Greer, Burns & Crain, Ltd.

[57] ABSTRACT

A buoyancy compensator assembly for a diver is provided with a vest having an inner gas impermeable layer adapted to face a wearer and a congruently shaped opposing gas impermeable outer layer. The peripheral edges of the inner and outer layers are sealingly bonded to each other. The vest has an opening through a back portion of the vest. A backpack for removably retaining a longitudinally extending breathing gas tank has a baseplate generally disposed within the opening. Attached to the periphery of the baseplate is an edge. The edge is disposed between and integrally bonded to the inner and outer layers whereby the layers form a chamber to be selectively inflated to adjust the buoyancy of the diver. A restraining sheet is located between and alternately attached to the inner layer and outer layer to form aligned bands. The sheet forces the inner layer to curve inward about the sides of the diver when the chamber is inflated. The backpack is constructed so that when the breathing gas tank is strapped onto the backpack the baseplate curves to fit about the back of the diver.

23 Claims, 3 Drawing Sheets

BUOYANCY COMPENSATOR HAVING ATTACHED BACKPACK

FIELD OF THE INVENTION

This invention generally relates to the field of scuba equipment and more specifically to a buoyancy compensator having an attached backpack. During use, the buoyancy compensator and backpack conform about a diver's body.

BACKGROUND OF THE INVENTION

The buoyancy compensator is a vest-shaped device worn about a diver's upper torso to assist in maintaining a diver's buoyancy at a neutral point under water. Within the buoyancy compensator there is an inflatable air bladder. By inflating and deflating the air bladder, the buoyancy of the buoyancy compensator and therefore the diver may be adjusted.

A backpack, on which is mounted one or more pressurized air tanks, is frequently attached to the buoyancy compensator. The backpack rests against the back of the diver, and belting on the buoyancy compensator secures the buoyancy compensator and backpack about the diver's upper torso. It is important for the diver's comfort that the buoyancy compensator and backpack are securely attached to each other and that they both act to conform about the diver's upper torso.

One style of buoyancy compensator is generally formed by an inner and outer lining of polyurethane coated nylon cloth. Each lining has a gas impermeable polyurethane inner layer and a nylon outer backing layer. The two linings are oriented so that the polyurethane inner layers are opposite each other and the nylon backing layers face outward. The inner polyurethane layers are integrally bonded together about the inner and outer peripheral edges of the linings to form a gas tight seal and thereby the inflatable air bladder. The bonding of the polyurethane layers is generally accomplished with RF welding. The backpack is attached to the backside of the buoyancy compensator by means of stitching, belts, fasteners, or the like. An important assembly consideration of conventional buoyancy compensators is that at the attachment point, one or both of the cloth linings may be cut or punctured. To prevent leakage from the air bladders at the attachment point, the polyurethane layers of cloth linings are bonded together to establish an air tight seal which encircles the attachment point.

One of the drawbacks of the prior art buoyancy compensators is the method of attaching the backpack to the compensator. The attachment of the backpack to the compensator by stitching, belting, or fastening, followed by sealing about the attachment point adds costly steps to the construction of the compensator.

An additional drawback of conventional buoyancy compensators is the discomfort the attached backpack may cause the diver. The backpack is generally made of a rigid polymer, and the part of the backpack which interfaces with a diver's back is generally planar. When the compensator and backpack are securely fastened to the diver, the planar backplate contacts and presses against the generally curved back of the diver, which may cause discomfort.

A further drawback is that when the air bladder within the buoyancy compensator is inflated, the generated pressure generally causes ballooning of the linings. This ballooning is undesirable as it may squeeze the diver and restrict the diver's movements. The ballooning may be lessened by restraining the distance the linings can move apart from each other. One present arrangement for restraining the linings is to bond opposing portions of the two linings to each other or to attach a series of vertical internal restraints to the linings. The restraints are attached to the linings by bonding the restraints to the inner layers of the linings at directly opposing locations. The restraints typically are aligned to each other and placed in that portion of the compensator which extends about the sides of the diver's torso. However, when the compensator is inflated and the frontal portions of the buoyancy compensator are secured about a diver's torso, these types of internal restraints cause the linings to form a planar configuration or flatten out. This flattening out of the vest, particularly in that portion of the vest extending about the sides of the diver, causes so-called "diver squeeze" which is undesirable.

It is therefore an object of the present invention to provide a buoyancy compensator vest and attached backpack which conforms about a diver's torso. A related object is to provide a backpack having a baseplate which conforms to the back of a diver.

It is also an object of the present invention to provide a buoyancy compensator vest and backpack in which the backpack is attached to the compensator vest at the attachment point and is sealed in a single step.

It is an additional object of the present invention to provide a buoyancy compensator having linings which curve about the sides of a diver when the air bladder is inflated.

SUMMARY OF THE INVENTION

Accordingly, a buoyancy compensator assembly for a diver is provided with a vest having an inner gas impermeable layer adapted to face a wearer, and a congruently-shaped, opposing gas impermeable outer layer. The peripheral edges of the inner and outer layers are sealingly bonded to each other. The vest has an opening through the inner and outer layers in a back portion of the vest. A backpack is provided for removably retaining a longitudinally extending breathing gas tank, and has a baseplate generally disposed within the opening. The baseplate includes a peripheral edge extending into the vest. The edge is disposed between, and sealingly bonded to the inner and outer layers of the vest, so that the layers form an inflatable chamber to be selectedly inflated to adjust the buoyancy of the diver. Thus, an important feature of the present invention is that the backpack is secured to the vest, and the inner and outer layers of the vest are sealed to each other in a single step.

Another feature of the present invention is a restraining sheet located between, and alternately attached to, the inner layer and outer layer to form aligned bands. The sheet forces the inner layer to curve inward to fit about the sides of the diver when the chamber is inflated.

Yet another feature of the present invention is that the backpack is constructed so that when the breathing gas tank is strapped onto the backpack, the baseplate curves to fit about the back of the diver.

BRIEF DESCRIPTIONS OF THE DRAWINGS

Figure 3:
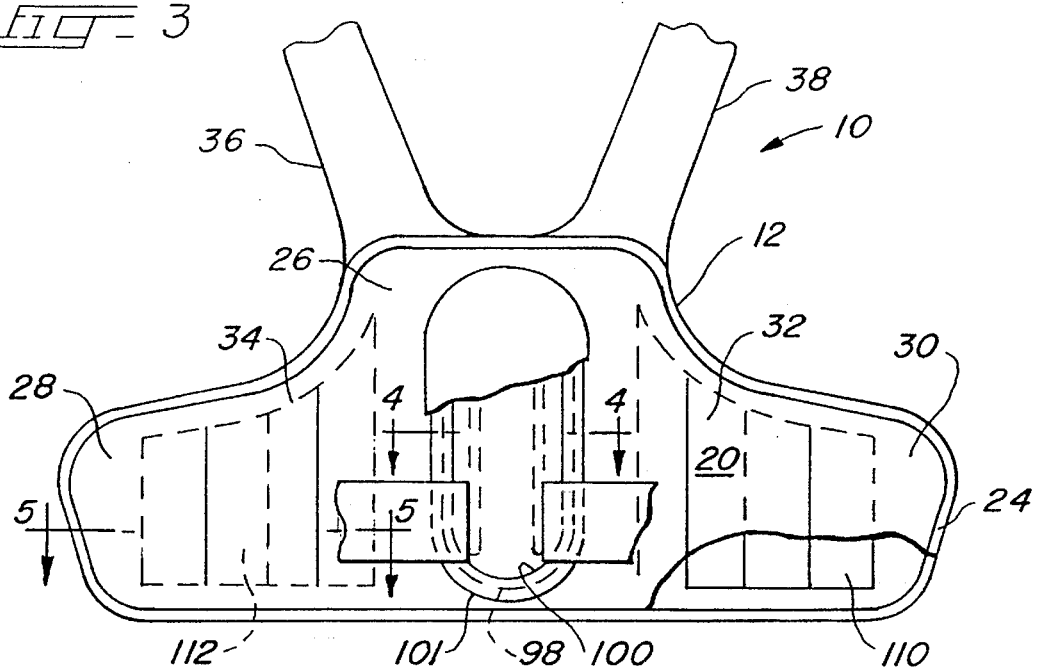
FIG. 3 is a frontal elevational view of the buoyancy compensator of FIG. 2 in an opened position and with parts shown broken away for clarity.
Figure 4:
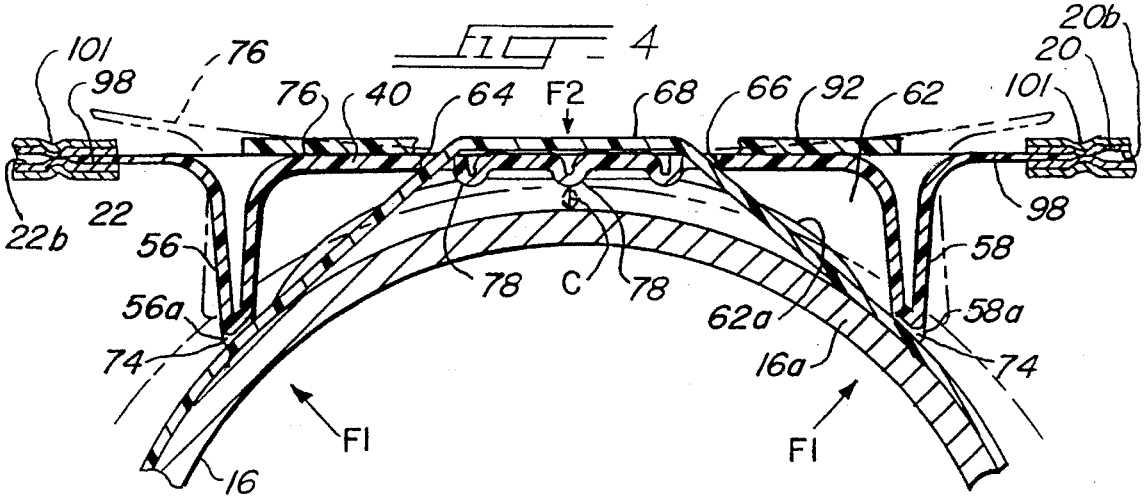
FIG. 4 is a sectional view taken along the line 4—4 of FIG. 3 and in the direction indicated generally.
Figure 4A:
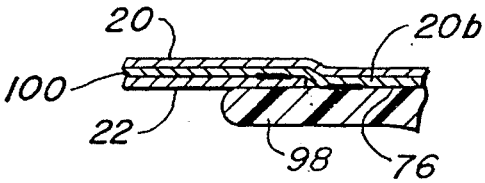
Figure 5:
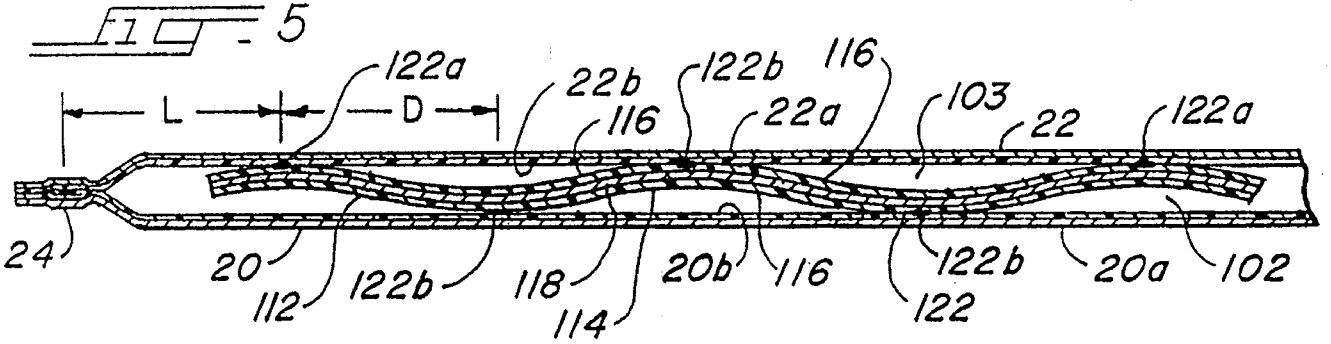
Figure 6:
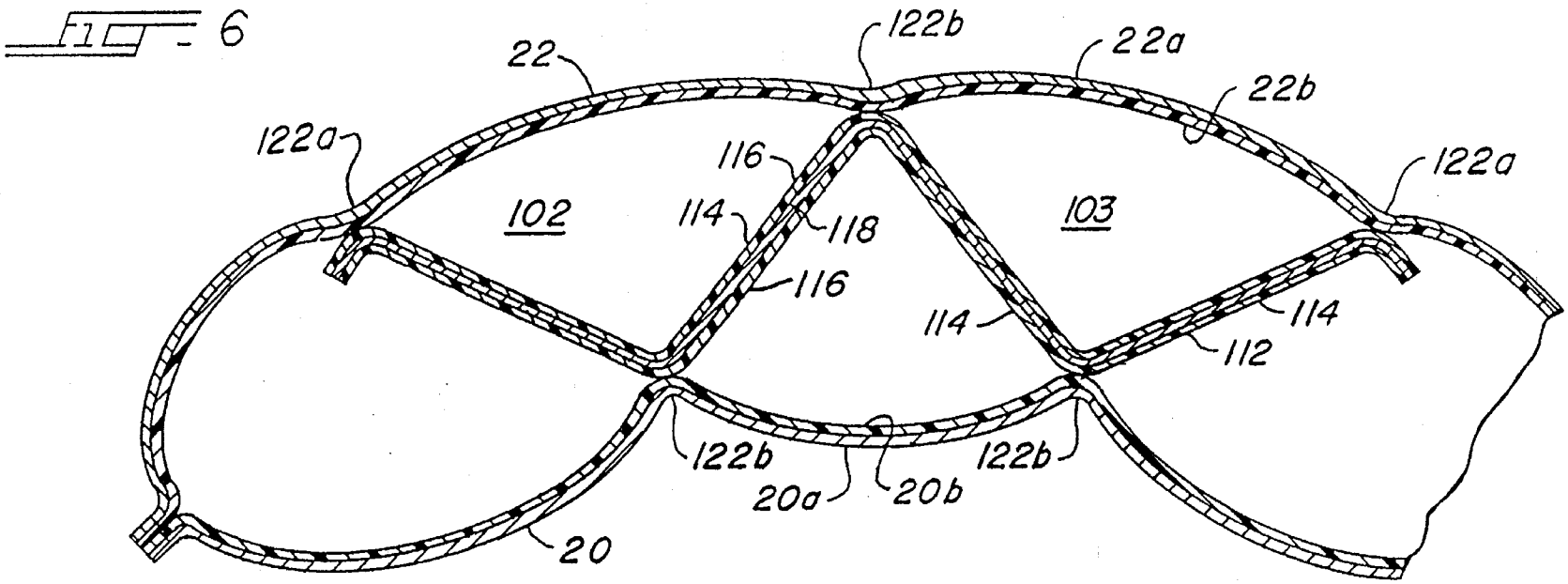

FIG. 4*a* is an expanded sectional view of an alternate attachment between the buoyancy compensator and backpack;

FIG. 5 is a sectional view taken along the line 5—5 of FIG. 3 and in the direction indicated generally showing the buoyancy compensator deflated; and FIG. 6 is the view of FIG. 5 with the buoyancy compensator inflated.

DESCRIPTION OF THE PREFERRED EMBODIMENTS

Figure 1:
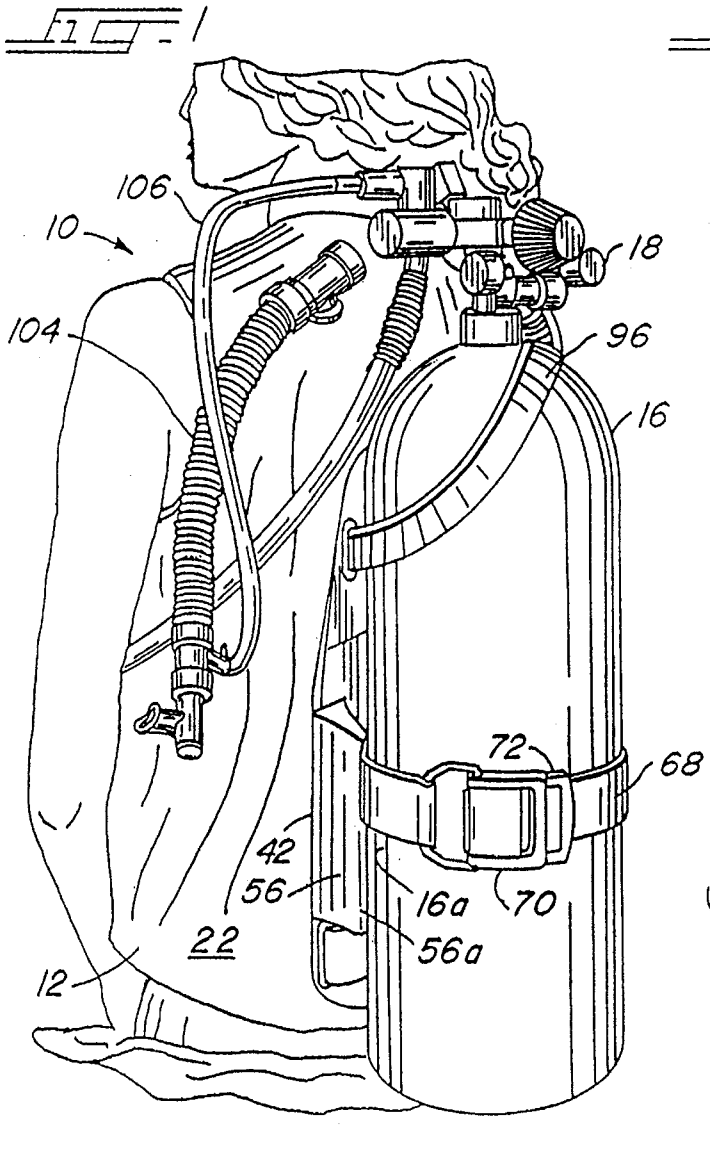
FIG. 1 is a rear perspective view of a diver wearing the buoyancy compensator of the invention.

Referring to FIG. 1, a buoyancy compensator embodying the present invention is indicated generally at 10. The buoyancy compensator 10 includes a vest 12 and attached backpack 14. The backpack 14 supports at least one tank 16 of compressed air or other breathing gas on which is mounted a regulator 18.

Figure 2:
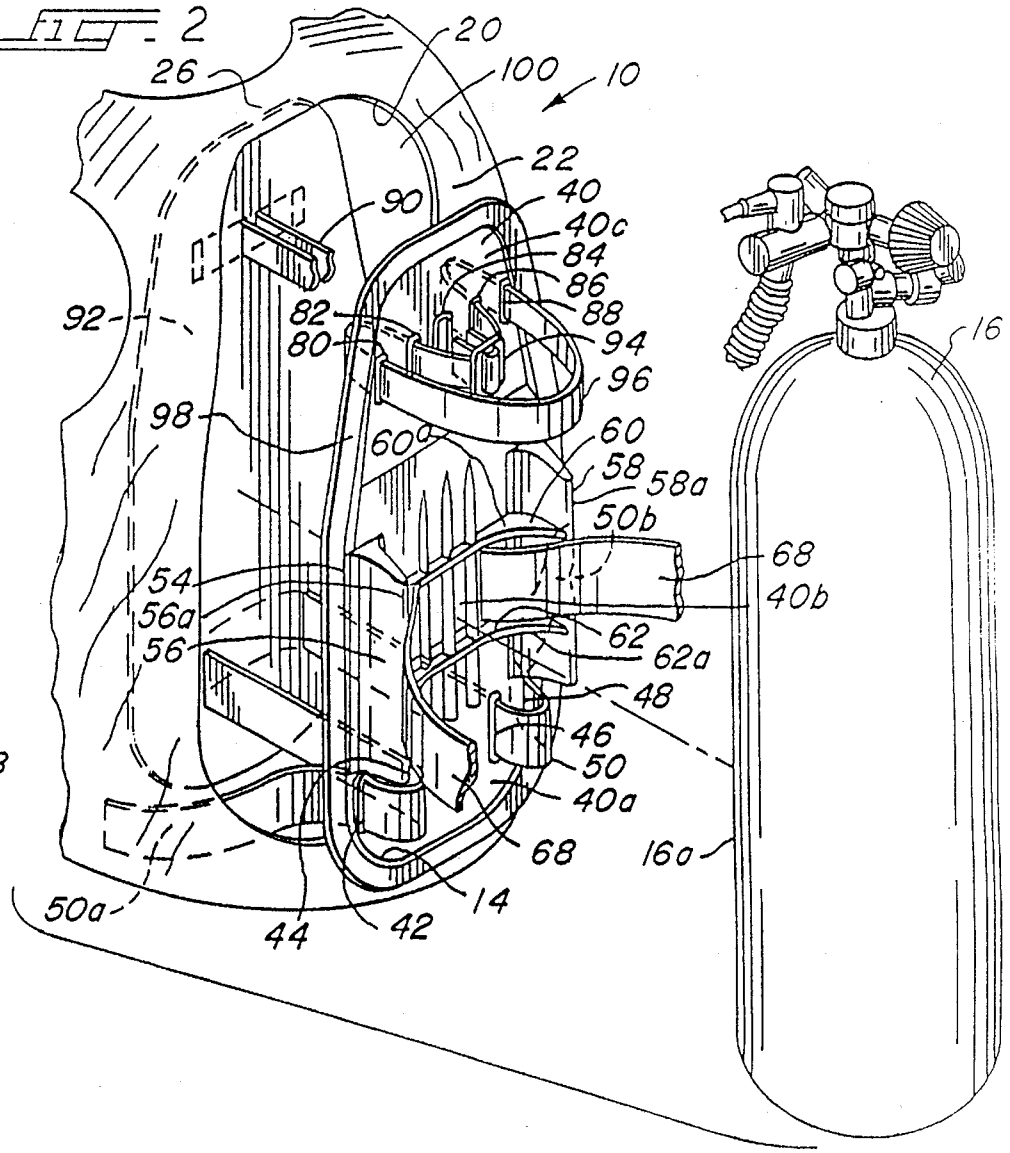
FIG. 2 is a rear exploded perspective view of the buoyancy compensator of FIG. 1.

Referring to FIGS. 2, 3 and 5, the vest 12 is formed of an inner lining 20 and a congruently shaped outer lining 22. The inner and outer linings 20, 22 preferably are composed of a material having a nylon cloth outer layer 20*a* and 22*a* and a gas impermeable polyurethane inner layer 20*b* and 22*b*. The inner and outer linings 20, 22 are attached to each other about their peripheral edges 24 to establish an air tight seal. This attachment is accomplished by integrally bonding the opposing inner layers 20*b*, 22*b* to each other by electric or RF welding as is well known in the art. The bonding may also be accomplished with adhesives or other suitable means.

Referring to FIG. 3, the vest 12 includes a back portion 26 which extends about the back of the diver; left and right frontal portions 30, 28 (as worn by the diver); and left and right side portions 32, 34 which correspond to, and extend about the sides of a diver's upper torso. The left front and side portions 30, 32 and right front and side portions 28, 34, form openings 38 and 36, respectively, for the diver's arms.

Referring to FIG. 2, the backpack 14 is preferably composed of a generally stiff yet resilient material such as polyurethane or the like. The backpack 14 includes a vertically extending base plate 40. A lower portion 40*a* of the base plate 40 has a plurality of laterally spaced, vertically oriented slots 42, 44, 46, 48 through which passes a cummerbund belt 50 to secure the backpack 14 about the diver's waist. The belt 50 may pass through the slots 42, 44, 46, 48 so that it passes from inside the vest 12 through slot 42 to the outside and returns to the inside through slot 44. The belt 50 then passes from the inside through slot 46 to the outside and returns to the inside through slot 48. The left and right ends 50*a* and 50*b* of the cummerbund 50 are secured about the waist by an attachment mechanism such as a VELCRO® brand, hook and loop fastener arrangement.

Rigidly and integrally connected to, and extending longitudinally along sides 54 of a middle portion 40*b* of the base plate 40 is a pair of thinned, outwardly protruding and generally vertically extending supports 56 and 58. The tops or rearwardly facing edges 56*a*, 58*a* of the supports 56, 58 contact the tank 16 along the sides of the frontal portion 16*a* of the tank (best seen in FIG. 1). Laterally extending between the supports 56, 58 are upper and lower ribs 60, 62.

Returning to FIG. 4, between the supports 56 and 58 and between the ribs 60 and 62, (best seen in FIG. 2), the baseplate 40 has a pair of slots 64, 66. A tank securement band 68 circumscribes the tank 16, and extends from the tank through the slot 64 to the inside of the vest 12 and returns outward to the tank through the slot 66. The band 68 is clamped about the tank by an overcenter latch 70 (best seen in FIG. 1) or other suitable means. The overcenter latch 70 also provides an adjustment portion 72 to vary the length of the band 68 as is well known in the art. Each of the tops 56*a*, 58*a* of the supports 56, 58, respectively, have notches 74 formed to allow for the passage of the band 68 around the tank 16 without a pinching of the band by the supports.

The upper and lower ribs 60 and 62 have concave curved outer edges 60*a*, 62*a* opposite the tank 16. When there is no tension in the band 68 and the backpack is in a relaxed position, as shown in solid lines in FIG. 4, the base plate 40 has a generally planar inner surface 76. Also, when the backpack is in a relaxed position, the upper and lower ribs 60 & 62 and supports 56, 58 are configured so that as the front portion 16a of the tank 16 contacts the supports, there is a clearance C between the outer edges 60*a* and the tank. Tightening the band 68 during securement of the tank 16 draws the tank toward the baseplate 40 and the clearance C diminishes. The tightening also causes the tank 16 to push against each of the supports 56, 58 with lateral and forward directed forces F1 while the band 68 is applying a force F2 on the central area of the baseplate, which is directed outward toward the tank 16. The laterally offset forces F1 and F2 cause the inner surface 76 to bend and form a convex curve, in the lateral direction, as shown in phantom lines in FIG. 4. This convex shape conforms the inner surface 76 of the backpack 14 more closely to the back of the diver than previous configurations.

The upper & lower ribs 60 and 62, and baseplate 40, being composed of a resilient material, cause the baseplate 40 and supports 56, 58 of the backpack 14 to exert an outward springlike or biasing force against the tank 16. The biasing force is translated into a tensile force in the band 68. This spring-like force is important because the band 68 is typically made of a woven material such as nylon webbing which has a tendency to slightly lengthen or slacken when the band becomes wet, which typically occurs when the diver goes into the water. When the band 68 slackens, the biasing force of the backpack 14 displaces the tank 16 away from the baseplate 40 which absorbs the slack and prevents the band from loosening so that the tank remains firmly secured to the backpack 14.

The baseplate 40 also includes a set of longitudinal bracing ribs 78 which extend through the upper & lower ribs 60 and 62 between slots 64 and 66. The bracing ribs 78 strengthen the central area between the slots 64 and 66 to prevent any breakage or bending of the baseplate due to the force F2 applied on the baseplate 40 by the band 68.

Referring now to FIGS. 2 and 4, an upper portion 40*c* of the baseplate 40 may have a set of five laterally aligned slots 80, 82, 84, 86 and 88. Through the middle slot 84 extends a loop of an elastic webbing 90 having ends which, in the preferred embodiment, are attached to a back padding 92. The back padding 92 is congruently shaped with the baseplate 40 and fits flush against the inner surface 76 (partially shown in FIG. 4) and between the baseplate 40 and the diver. A bar slide 94, through which the elastic webbing 90 extends, is sized so that when the slide is flush against the baseplate 40, the slide prevents the loop from going through the middle slot 84, but the slide can travel through the slot 84 when turned on its side so that the back padding 92 may be replaced. The back padding 92 may also be secured against the inner surface 76 by threading the cummerbund belt 50 through the padding as the belt extends from slot 44 to slot 46 of the baseplate 40.

A tank locator strap 96 has an outer loop which circumscribes the upper portion of the tank 16 to locate the buoyancy compensator in a preferred position on the tank. One end of the strap 96 may pass through the slots 80, 82 so that it passes from the outside through slot 80 to the inside and then returns through slot 82 to the outside where the end is then threaded through the bar slide 94. Similarly the other end of the strap 96 passes from the outside through slot 88 to the inside and then returns through slot 86 where the end is threaded through the bar slide 94. By adjusting the length of the strap 96 with the bar slide 94, the strap 96 securably locates the tank 16 upon the backpack 14.

Referring now to FIGS. 2–4, to connect the backpack 14 to the vest 12, the baseplate 40 is integrally and rigidly attached to a peripheral thinned edge 98 which is preferably composed of polyurethane. The central portion of the back portion 26 of the vest 12 is provided with an opening 100 which extends through the inner and outer linings 20, 22 and is sized to fit about the edge 98 so that the edge is sandwiched between the inner and outer linings 20, 22 of the vest 12 in a zone bordering the opening 100. Returning to FIG. 4, because the edge 98 is of the same general polyurethane composition as the inner layers **20*b*, 22*b* of the inner and outer linings 20, 22, respectively, the edge 98 is attached to the linings by integrally bonding the edge to the inner polyurethane layers 20*b*, 22*b*, to establish an air-tight seal. The bonding is preferably accomplished by RF or electric welding or other suitable means. The backpack 14 is thus attached to the vest 12** and the air tight seal is established about the attachment point in a single step which reduces manufacturing expenses.

If desired, a secondary seal 101 may be formed between the inner and outer linings 20, 22 to circumscribe the edge 98 of the backpack 14. The secondary seal 101 is formed by bonding the inner polyurethane layers **20*b*, 22*b* of the inner and outer linings 20, 22 to each other. The bonding can be performed at the same time as the bonding between the edge 98 and the linings 20, 22**.

Referring to FIG. 4A, in an alternate embodiment, only the outer lining 22 has the opening 100, and the inner surface 76 of the baseplate 40 contacts the inner lining 20. To form air-tight seals, the edge 98 is integrally bonded to the inner layer **20*b* of the inner lining 20 to attach the backpack to the vest, and the inner and outer linings 20, 22 are integrally bonded to each other immediately adjacent the edge 98 to form an air-tight seal. The bonds between the edge 98 and inner layer 20*b* and between the inner and outer linings 20, 22** may be performed in a single process.

Referring now to FIG. 5, with the bonding of the inner lining 20 to the outer lining 22 about their peripheral edges 24 and the bonding between the edge 98 (FIG. 4) and the inner and outer lining about the opening, an air-tight bladder 102 is formed. The bladder 102 defines an air tight chamber 103. The present buoyancy compensator 12 is not limited to vests having two-layer inner and outer linings but may also include vests having outer linings and separate inner linings which form the air bladder, whereby the edge 98 would be integrally bonded to the air bladder and the outer lining may be attached to the backpack by appropriate attachment means.

Referring to FIG. 1, to provide air to the bladder 102, the buoyancy compensator 10 includes a power inflator assembly 104 in communication with the chamber 103. The inflator assembly 104 can be of the type known in the prior art, and is connected by hose 106 to the regulator 18 attached to the tank 16.

Referring now to FIGS. 3 and 5, when the bladder 102 is inflated, a left and right restraining system generally designated 110 and 112 cause the left and right side portions 32 and 34 to form inwardly curving arcs which conform about the sides of the diver. Referring to FIG. 5, the right restraining system 112 includes a sheet 114 of material having outer layers 116 of polyurethane sandwiching an inner layer of nylon cloth 118. The sheet 114 is configured so that the upper and lower peripheral edges of the sheet form a gap between the sheet 114 and the upper and lower peripheral edges 24 of the vest 12 to permit free air flow around the sheet and, therefore, throughout the chamber 103.

The sheet 114 is attached to the vest 12 to form an odd number of at least three vertically aligned attachment bands or ribs 122. The outer attachment bands **122*a* of the sheet 114 are attached to the outer lining 22 and the intermediate attachment bands 122*b* alternate between the inner lining 20 and the outer lining 22 to form a corrugated appearance when viewed from above. For example, in the preferred embodiment there are five attachment bands 122 formed between the sheet 114 and inner and outer linings 20, 22. The outer attachment bands 122*a* are bonded to the outer lining 22. The intermediate bands 122*b* adjacent the outer bands 122*a* are attached to the inner lining 20 and the intermediate band 122*b* in the center is attached to the outer lining 22**.

Referring now to FIG. 6, when the air bladder 102 is inflated, the sheet 114 restrains the distance the inner lining 20 and outer lining 22 may move apart from each other. In addition, the alternating attachment of the sheet 114 to the inner lining 20 and outer lining 22 causes the portion of the air bladder 102 that is restrained by the restraining system 112 to form an inwardly curved and flexible lateral cross-section that conforms about the sides of the diver's torso, minimizing diver squeeze.

The sheet 114 is attached to the inner and outer layer to form the ribs 122 preferably by bonding the polyurethane outer layers 116 to the polyurethane inner layers **20*b* and 22*b* of the inner and outer linings 20, 22** by RF welding or other suitable means.

The left restraining system 110 is constructed in a similar manner as the right restraining system 112 described above with a sheet 114 alternately attached to the inner and outer linings 20, 22, so that when the air bladder 102 is inflated, the restrained portion of the bladder curves to conform about the left side of the diver.

A specific embodiment of the novel buoyancy compensator having an attached backpack according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

I claim:

1. A buoyancy compensator assembly comprising:

a vest having a first gas impermeable layer adapted to face a wearer and a congruently shaped opposing gas impermeable second layer, said first and second layers being sealingly bonded to each other about the peripheral edges thereof, said vest forming an opening through at least said second layer in a back portion of said vest;

a backpack having retaining means for removably retaining a breathing gas tank, said backpack having a baseplate attached to said retaining means and generally disposed within said opening; and an edge attached to and extending about the periphery of said baseplate, said edge being disposed within said opening between said first and said second layer and integrally and sealingly bonded to said first layer and to a peripheral edge of said opening of at least said second layer, said first and said second layers and said baseplate edge defining an inflatable chamber.

2. The compensator assembly of claim 1 further including restraining means disposed between and alternately attached to said first and second layers at attachment bands for curving said first layer about the sides of the wearer of the vest when said chamber is inflated, wherein said attachment bands of said restraining means on said first layer are staggered horizontally with respect to said attachment bands of said second layer.

3. The compensator assembly of claim 1 wherein said baseplate has an inner surface opposite from said retaining means, said inner surface being generally planar when said backpack is in a relaxed position, said retaining means including means for causing a lateral curvature of said inner surface when a tank of breathing gas is secured to said backpack.

4. The compensator assembly of claim 1 wherein said edge is integrally bonded to said first and second layers by RF welding.

5. The compensator assembly of claim 1 wherein said vest includes a first exterior layer and a congruently shaped second exterior layer, said first exterior layer and said second exterior layer enclosing said first layer and said second layer.

6. The compensator assembly of claim 5 wherein said first exterior layer is bonded to said first layer to form an inner lining and said second exterior layer is bonded to said second layer to form an outer lining.

7. The compensator assembly of claim 1 wherein said baseplate is longitudinally elongated and has an inner surface facing the back of a user and curving means attached to said baseplate for laterally curving said inner surface when the tank is secured to said baseplate.

8. The compensator assembly of claim 7 wherein said curving means includes a pair of supports attached to and extending outward along a portion of the lateral sides of said baseplate, said supports configured to contact the sides of a frontal portion of the tank opposite said baseplate and to position the tank to form a clearance between said tank and said baseplate, and means contacting said baseplate for drawing said tank toward said baseplate to reduce said clearance.

9. A scuba diving backpack for use with a buoyancy compensator for removably securing a tank of breathing gas thereto, said backpack comprising:

a longitudinally elongated baseplate having an inner surface facing the back of a user; and curving means attached to said baseplate for laterally curving said inner surface when the tank is secured to said baseplate.

10. The backpack of claim 9 wherein said curving means includes;

a pair of supports attached to and extending outward along a portion of the lateral sides of said baseplate, said supports configured to contact the sides of a frontal portion of the tank opposite said baseplate and to position the tank to form a clearance between said tank and said baseplate, and means contacting said baseplate for drawing said tank toward said baseplate to reduce said clearance.

11. A buoyancy compensator for a diver comprising:

at least one air bladder for receiving gas, said bladder including a first gas impermeable lining opposite a second gas impermeable lining; and restraining means disposed between said first lining and said second lining and attached to said first lining and said second lining for curving said first lining about the sides of the diver, said restraining means including a sheet, said sheet being alternately attached to said first lining and said second lining to form at least three generally aligned attachment bands.

12. The compensator of claim 11 wherein said bands include a pair of outer bands attached to said second lining and at least one band intermediate to said outer bands and connected to said first lining.

13. The compensator of claim 12 wherein said bands include an odd number of intermediate bands alternatingly attached to said first lining and said second lining, with said intermediate bands adjacent to said outer bands attached to said first lining.

14. The compensator of claim 13 wherein the distance between adjacent bands of said intermediate and said outer bands is generally equal.

15. The compensator of claim 13 wherein said first lining is attached to said second lining to form at least one peripheral edge, at least a segment of said peripheral edge being generally aligned with at least one of said outer attachment bands.

16. A buoyancy compensator for removably securing a tank of breathing gas and conforming about the back and sides of a diver, said buoyancy compensator comprising:

a vest which fits about the back and sides of a diver, said vest including at least one air bladder for receiving gas, said bladder including a first gas impermeable lining opposite a second gas impermeable lining, and restraining means disposed between said first and second linings and attached to said first and second linings for curving said first lining about the sides of the diver; and a backpack attached to said vest for removably securing the tank of breathing gas, said backpack including a longitudinally elongated baseplate having an inner surface facing the back of the diver and means attached to said baseplate for laterally curving said inner surface when the tank is removably secured to said baseplate.

17. The buoyancy compensator of claim 16 wherein said vest includes a back portion forming an opening through at least said first lining, said base plate being located in said opening and attached to a peripheral edge thereof, said edge being disposed between and integrally bonded to said first lining and said second lining.

18. The buoyancy compensator of claim 16 wherein said restraining means includes at least one sheet, said sheet being alternately attached in a corrugated configuration to said first lining and said second lining to form at least three aligned attachment bands.

19. The buoyancy compensator of claim 16 wherein said curving means includes a pair of supports attached to and extending outward along a portion of the lateral sides of said baseplate, said supports configured to contact the sides of a frontal portion of the tank opposite said baseplate and to position the tank to form a clearance between said tank and said baseplate, and means contacting said baseplate for drawing said tank toward said baseplate to reduce said clearance.

20. The buoyancy compensator of claim 19 wherein said drawing means includes a strap circumscribing the tank and threaded through said baseplate, said backpack including biasing means for displacing the tank away from said baseplate after the tank has been drawn toward said baseplate and upon slackening of said strap.

21. A buoyancy compensator assembly comprising:

a vest having a first gas impermeable layer adapted to face a wearer and a congruently shaped opposing gas impermeable second layer, said first and second layers being sealingly bonded to each other about the peripheral edges thereof, said vest forming an opening through at least said second layer in a back portion of said vest;

a backpack having retaining means for removably retaining a breathing gas tank, said backpack having a baseplate attached to said retaining means and generally disposed within said opening, said baseplate having an inner surface opposite from said retaining means, said inner surface being generally planar when said backpack is in a relaxed position, said retaining means including means for causing a lateral curvature of said inner surface when a tank of breathing gas is secured to said backpack; and an edge attached to and extending about the periphery of said baseplate, said edge being disposed between said first and said second layers and integrally bonded to said first and second layers, said first and said second layers forming an inflatable chamber.

22. The compensator assembly of claim 21 wherein said edge is disposed within said opening between said first and second layers and is integrally and sealingly bonded to a peripheral edge of an opening in said first layer and said peripheral edge of said opening of said second layer to define an inflatable chamber.

23. The compensator assembly of claim 21 wherein said means for causing a lateral curvature includes a pair of supports attached to and extending outward along a portion of the lateral sides of said baseplate, said supports configured to contact the sides of a frontal portion of the tank opposite said baseplate and to position the tank to form a clearance between said tank and said baseplate, and means contacting said baseplate for drawing said tank toward said baseplate to reduce said clearance.

* * * * *